US006200098B1

(12) United States Patent
Kennedy et al.

(10) Patent No.: US 6,200,098 B1
(45) Date of Patent: Mar. 13, 2001

(54) SPEED LIMITED FAN

(75) Inventors: Larry C. Kennedy, Commerce Township; George Moser, Wixom, both of MI (US)

(73) Assignee: Behr America, Inc., Walled Lake, MI (US)

( * ) Notice: Subject to any disclaimer, the term of this patent is extended or adjusted under 35 U.S.C. 154(b) by 0 days.

(21) Appl. No.: 09/346,508

(22) Filed: Jul. 1, 1999

(51) Int. Cl.[7] ..... B63H 1/06; A47C 21/04

(52) U.S. Cl. ..... 416/131; 416/169 A; 416/241 A

(58) Field of Search ..... 416/131, 134 R, 416/135, 169 A, 234, 241 R, 241 A

(56) References Cited

U.S. PATENT DOCUMENTS

| | | | | |
|---|---|---|---|---|
| 2,657,852 | * | 11/1953 | Spase | 416/169 A X |
| 3,307,634 | | 3/1967 | Bihlmire . | |
| 3,477,794 | | 11/1969 | Abbott et al. . | |
| 3,701,611 | | 10/1972 | Lambrecht . | |
| 3,748,061 | | 7/1973 | Henrich . | |
| 3,749,519 | * | 7/1973 | Ryba | 416/241 R |
| 3,937,595 | * | 2/1976 | English et al. | 416/244 R |
| 3,953,149 | | 4/1976 | Henne | 416/136 |
| 3,969,805 | | 7/1976 | Lievens et al. . | |
| 4,245,957 | * | 1/1981 | Savage et al. | 416/135 |
| 4,321,011 | * | 3/1982 | Hori et al. | 416/241 A X |
| 4,452,591 | | 6/1984 | Fishbaugh et al. . | |
| 4,487,551 | * | 12/1984 | Mizutani et al. | 416/135 |
| 5,201,679 | | 4/1993 | Velte, Jr. et al. . | |
| 5,207,561 | * | 5/1993 | Godichon | 416/134 R |
| 5,322,416 | | 6/1994 | Karls et al. . | |
| 5,385,448 | | 1/1995 | Merkt et al. . | |
| 5,399,070 | | 3/1995 | Alizaden . | |
| 5,501,010 | | 3/1996 | Scott . | |
| 5,573,376 | | 11/1996 | Hayden et al. . | |
| 5,655,882 | * | 8/1997 | Morgan et al. | 416/204 R |
| 6,073,593 | * | 6/2000 | Nilson et al. | 416/169 A X |

* cited by examiner

*Primary Examiner*—John E. Ryznic
(74) *Attorney, Agent, or Firm*—Howard & Howard

(57) ABSTRACT

The invention provides a method of driving a plurality of plastic fan blades (14) integrally molded with a band (16) about and engaging a metal driving hub (12) at an interface by rotating the fan blades (14) in unison with the hub (12) up to a predetermined rotational speed at which the band (16) flows or expands radially to create a space between the band (16) and the hub (12) whereby the fan blades (14) are allowed to rotate at a slower rotational speed than the hub (12) to prevent the fan blades (14) from bursting in response to centrifugal force. The drive connection may optionally include band projections (24) and/or male projections (26) which shear before or as the separation occurs. A film may be disposed at the interface to prevent the plastic of the fan blades (14) and band (16) from bonding to the metal hub (12).

15 Claims, 3 Drawing Sheets

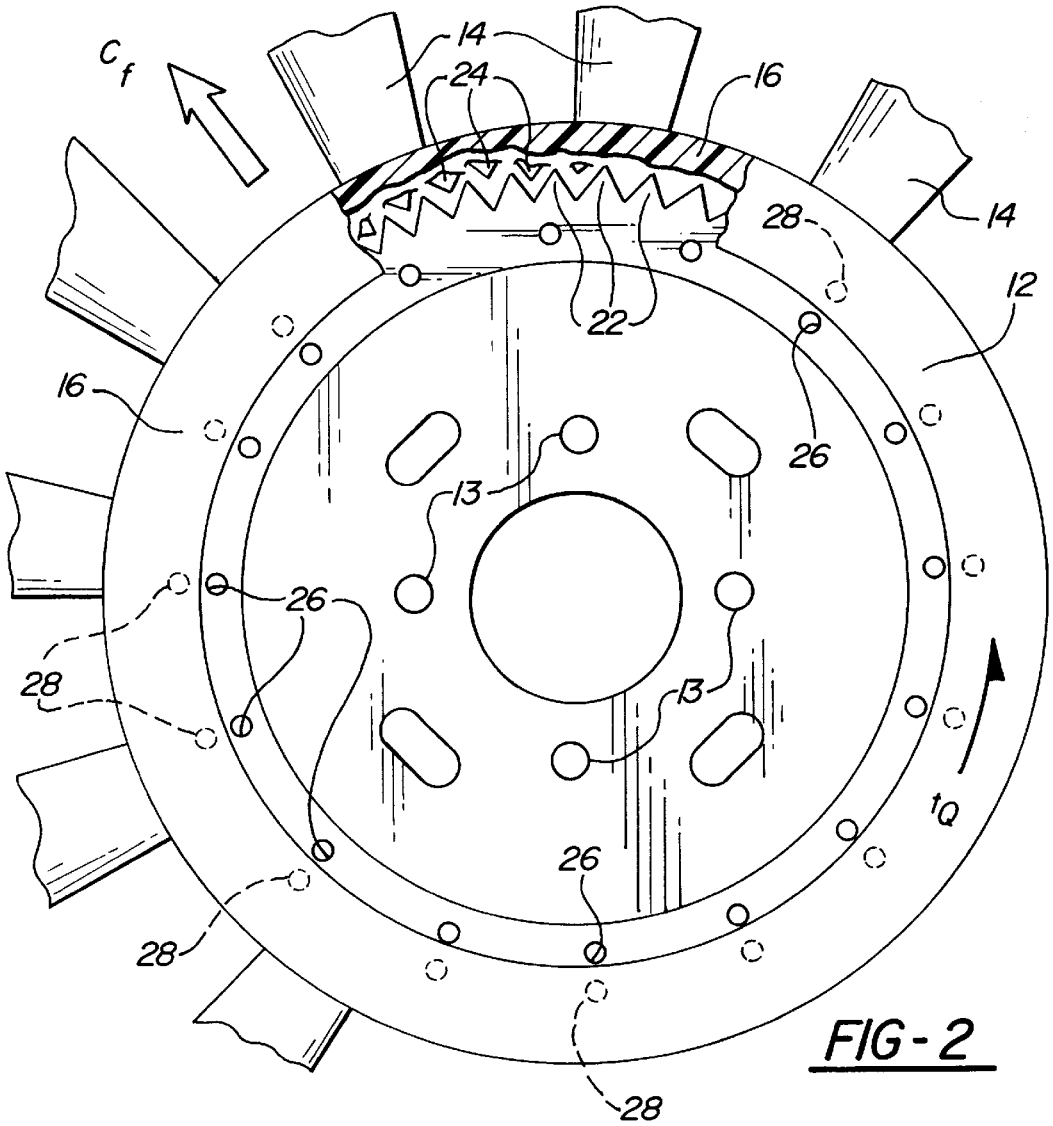
FIG-2
FIG-3
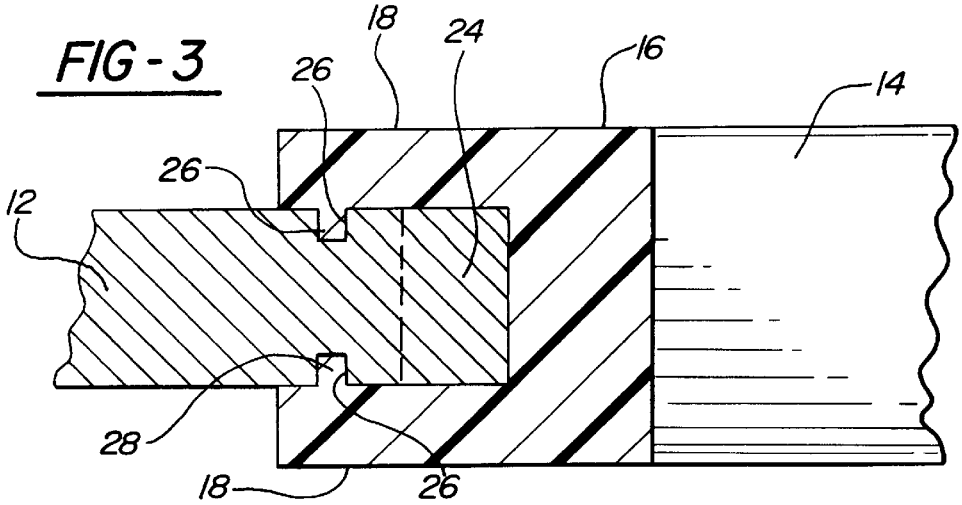

SPEED LIMITED FAN

BACKGROUND OF THE INVENTION

1. Field of the Invention

This invention relates to controlling the rotational speed of an axial fan with particular application to a cooling fan of the type used in automotive vehicles to move air through a heat exchanger.

2. Description of the Prior Art

A ring fan is typical of cooling fans used in automotive environments. A ring fan includes radially extending blades which are connected at the distal ends by a ring. The ring provides added stability and rigidity to the blades and improves noise performance of the fan. The fan noise is a serious problem in automobiles, especially light trucks and sport utility vehicles.

Despite the advantages of noise reduction and cooling performance of ring fans, they have not enjoyed widespread use because the burst speed of a ring fan is generally lower than the burst speed of conventional axil fans, the burst speed being that speed at which the fan will break apart, i.e., burst, in response to centrifugal forces generated by the rotation. Naturally, automobile manufacturers use fans with very high burst speeds. Because the ring adds mass to the outside diameter of the fan, which increases centrifugal forces proportionally to the radius squared, engine driven ring fans have not met the burst speed requirements of automotive manufacturers.

SUMMARY OF THE INVENTION AND ADVANTAGES

The invention provides a unique method of driving a plurality of fan blades disposed about and engaging a driving hub at an interface by rotating the fan blades in unison with the hub up to a predetermined rotational speed and rotating the fan blades at a slower rotational speed than the hub in response to the hub rotating at a higher rotational speed than the predetermined rotational speed to prevent the fan blades from bursting in response to centrifugal force.

The invention may be implemented in a fan assembly comprising a hub adapted for driving connection to a rotary drive and a plurality of fan blades extending radially from the hub. The fan blades consist of a first composition and the hub consists of a second composition different from the first composition. The assembly is characterized by a driving connection between the fan blades and the hub for rotating the blades in unison with the hub up to a predetermined rotational speed and for allowing rotation of the hub independently of and at a higher speed than the fan blades in response to the hub rotating at a higher rotational speed than the predetermined rotational speed to prevent the fan blades from bursting in response to centrifugal force.

Accordingly, the subject invention may be utilized in a ring fan to prevent the fan from ever reaching burst speed whereby ring fans, with all of their advantages, may be used more extensively without fear of breaking apart.

BRIEF DESCRIPTION OF THE DRAWINGS

Other advantages of the present invention will be readily appreciated as the same becomes better understood by reference to the following detailed description when considered in connection with the accompanying drawings wherein:

FIG. 2 is a view like FIG. 1 but showing the components after the drive connection has been disconnected;

FIG. 3 is a cross sectional view taken along line 3—3 of FIG. 1.

DETAILED DESCRIPTION OF THE PREFERRED EMBODIMENT

Figure 1:
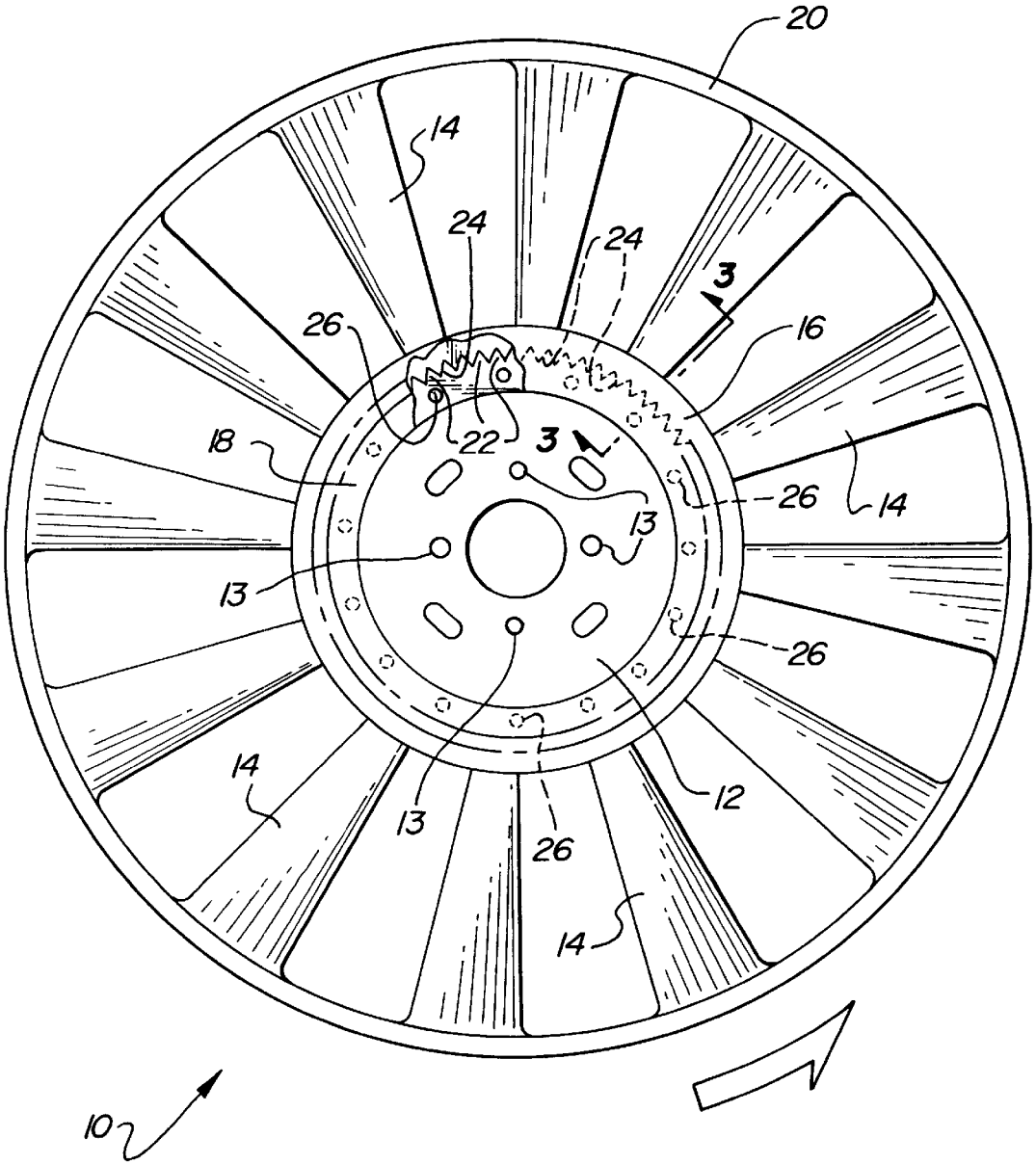
FIG. 1 is a fragmentary side view, partially broken away, of a preferred embodiment.

Referring to the Figures, wherein like numerals indicate like or corresponding parts throughout the several views, a fan assembly is generally shown at 10. The fan assembly 10 includes a hub 12 adapted by holes 13 for driving connection to a rotary drive (not shown), such as the engine of an automobile.

A plurality of fan blades 14 extend radially from the hub 12 and include an integral band 16 integrally interconnecting the fan blades 14 and extending about the hub 12. The band 16 includes flanges 18 extending radially to sandwich the hub 12 therebetween. In other words, the band 16 is U-shaped as viewed in cross section in FIG. 3 wrap around the periphery of the dish shaped hub 12. The fan blades 14 extend to distal ends and include a ring 20 extending about and interconnecting the distal ends of the fan blades 14.

The fan blades 14, which include the band 16 and the ring 20, consist of a first composition, preferably an organic polymeric material, i.e., plastic, whereas the hub 12 consists of a second composition different from the first composition, e.g., a metal or metal alloy.

The assembly 10 is characterized by a driving connection between the fan blades 14 and the hub 12 for rotating the blades 14 in unison with the hub 12 up to a predetermined rotational speed and for allowing rotation of the hub 12 independently of and at a higher speed than the fan blades 14 in response to the hub 12 rotating at a higher rotational speed than the predetermined rotational speed to prevent the fan blades 14 from bursting in response to centrifugal force. The fan blades 14, through the band 16, define an interface with the hub 12 and the drive connection is disposed at the interface. The drive connection includes hub projections 22 extending from the hub 12 and band projections 24 extending from the band 16 and interleaved or meshing with the hub projections 22. Both sets of projections 22 and 24 extend radially and are interleaved at the interface. The hub projections 22 have greater shear strength than the band projections 24 whereby the band projections 24 shear in response to a predetermined torque transmitted thereto by the hub projections 22.

In operation, the first or plastic composition of the fan blades 14 flows radially in response to centrifugal forces generated at the predetermined rotational speed to separate from the hub 12 at the interface. In order to facilitate this separation, it may be useful to include a film disposed between the hub 12 and the band 16 at the interface to prevent the band 16 from bonding to the hub 12. In other words, the integral plastic fan blade unit is molded about the hub 12 and to prevent bonding, the hub may be coated with a film as by spraying a polymer compound on the hub. The hub 12 may also include a plurality of female receivers or holes 26 and the band 16 includes a plurality of complementary male projections 28 extending axially from at least one of the flanges 18 and into the female receivers 26. The male projections 28 are integral with the band 16 and are molded therewith to extend from the legs of the U-shape into the female receivers or holes 26 in the opposite sides of the hub 12.

As the hub 12 rotates toward the burst speed, the male projections 28 shear and the centrifugal force moves the band 16 radially outward to create a space at the interface with the hub 16. The freedom of the fan blades 14 and the integral band 16 to rotate slower or not rotate at all, depends upon the configuration of the drive connection at the interface between the hub 12 and the band 16. If the drive connection relies only upon the friction between the band 16 and the hub 12, then the separation at the interface will be relatively immediate, whereas if the projections 22 and 24 are included, the depth of the projections must clear one another. Alternatively and preferably, the band projections 24, which are integral plastic and weaker than the metal of the hub 12, shear after a predetermined degree of separation between the band projections 24 and the hub projections 22, as illustrated in FIG. 2.

Figure 4:
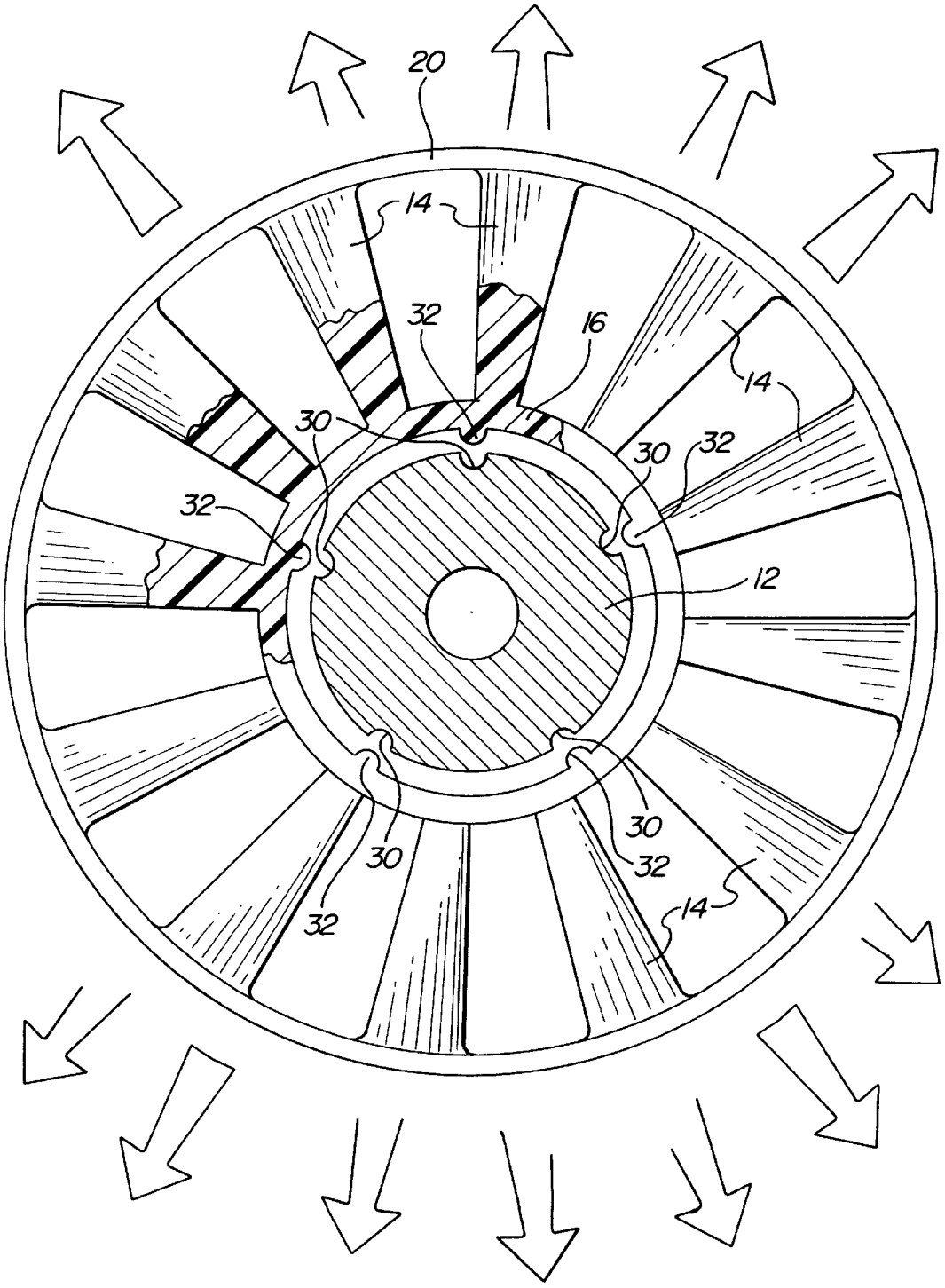
FIG. 4 is a view similar to FIG. 1 but showing an alternative drive connection.

An alternative drive connection is shown in FIG. 4 wherein the hub 12 has a plurality of concave recesses 30 into which are molded a plurality of convex tabs 32 whereby the convex tabs 32 withdraw radially from the concave recesses 30 in response to the rotational speed of the hub 12 reaching a predetermined speed which is lower than the burst speed of the fan blade assembly. As will be appreciated, various configurations and combinations of drive connections may be employed between the hub 12 and the band 16, it only being essential that the band 16 move radially relative to the hub 12 to effect a separation at the interface.

Accordingly, the invention provides a method of driving a plurality of fan blades 14 disposed about and engaging a driving hub 12 at an interface comprising the steps of rotating the fan blades 14 in unison with the hub 12 up to a predetermined rotational speed and rotating the fan blades 14 at a slower rotational speed than the hub 12 in response to the hub 12 rotating at a higher rotational speed than the predetermined rotational speed to prevent the fan blades 14 from bursting in response to centrifugal force. The method is further defined as disconnecting the fan blades 14 from driving connection to the hub 12 above the predetermined rotational speed of the hub 12. This is accomplished by the flow of the plastic material of the band 16 and fan blades 14. The additional and optional shearing step may be included, i.e., shearing the fan blades 14 from the hub 12 at the predetermined rotational speed by shearing the band projections 24. This occurs after the fan blades 14, i.e., the band 16, are separated radially at the interface from the hub 12 at the predetermined rotational speed.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein that which is prior art is antecedent to the characterized novelty and reference numerals arc merely for convenience and are not to be in any way limiting, the invention may be practiced otherwise than as specifically described.

What is claimed is:

1. A fan assembly comprising;

a hub (12) adapted for driving connection to a rotary drive, and a plurality of fan blades (14) extending radially from the hub (12), said fan blades (14) consisting of a first composition and said hub (12) consisting of a second composition different from said first composition, said assembly characterized by a driving connection between said blades (14) and said hub (12) for rotating said blades (14) in unison with said hub (12) up to a predetermined rotational speed and for allowing rotation of said hub (12) independently of and at a higher speed than said fan blades (14) in response to said hub (12) rotating at a higher rotational speed than said predetermined rotational speed to prevent said fan blades (14) from bursting in response to centrifugal force.

2. An assembly as set forth in claim 1 wherein said fan blades (14) include an integral band (16) integrally interconnecting said fan blades (14) and extending about said hub (12), said band (16) defining an interface with said hub (12), said drive connection being disposed at said interface.

3. An assembly as set forth in claim 2 wherein said first composition of said fan blades (14) flows radially in response to centrifugal forces generated at said predetermined rotational speed to separate from said hub (12) at said interface.

4. An assembly as set forth in claim 3 wherein said first composition consists of an organic polymeric material and said second composition consists of a metallic material.

5. An assembly as set forth in claim 2 including a film disposed between said hub (12) and said band (16) at said interface to prevent said band (16) from bonding to said hub (12).

6. An assembly as set forth in claim 2 wherein said drive connection includes hub projections (22) extending from said hub (12) and band projections (24) extending from said band (16) and interleaved with said hub projections (22).

7. An assembly as set forth in claim 6 wherein said projections (22 and 24) extend radially and are interleaved at said interface.

8. An assembly as set forth in claim 7 wherein said hub projections (22) have greater shear strength than said band projections (24) whereby said band projections (24) shear in response to a predetermined torque transmitted thereto by said hub projections (22).

9. An assembly as set forth in claim 2 wherein said band (16) includes flanges (18) extending radially to sandwich said hub (12) therebetween.

10. An assembly as set forth in claim 9 wherein said hub (12) includes a female receiver (26) and said band (16) includes a male projection (28) extending axially from at least one of said flanges (18) and into said female receiver (26).

11. An assembly as set forth in claim 2 wherein said fan blades (14) extend to distal ends and including a ring (20) extending about and interconnecting said distal ends.

12. A method of driving a plurality of fan blades (14) disposed about and engaging a driving hub (12) at an interface, said method comprising the steps of, rotating the fan blades (14) in unison with the hub (12) up to a predetermined rotational speed, and rotating the fan blades (14) at a slower rotational speed than the hub (12) in response to the hub (12) rotating at a higher rotational speed than the predetermined rotational speed to prevent said fan blades (14) from bursting in response to centrifugal force.

13. A method as set forth in claim 12 further defined as disconnecting the fan blades (14) from driving connection to the hub (12) above the predetermined rotational speed of the hub (12).

14. A method as set forth in claim 13 further defined as shearing the fan blades (14) from the hub (12) at the predetermined rotational speed.

15. A method as set forth in claim 13 further defined as separating the fan blades (14) radially at the interface from the hub (12) at the predetermined rotational speed.

* * * * *